US006213835B1

(12) United States Patent
Wolthoff

(10) Patent No.: US 6,213,835 B1
(45) Date of Patent: Apr. 10, 2001

(54) CHANGEABLE NEON LETTERS

(76) Inventor: Charles Edwin Wolthoff, 378 Frances Pl., Wyckoff, NJ (US) 07481-2422

( * ) Notice: Subject to any disclaimer, the term of this patent is extended or adjusted under 35 U.S.C. 154(b) by 0 days.

(21) Appl. No.: 09/476,467

(22) Filed: Dec. 30, 1999

(51) Int. Cl.[7] ..... H01J 9/00

(52) U.S. Cl. ..... 445/22; 439/786; 24/341; 403/397; 403/398; 40/130

(58) Field of Search ..... 445/22; 439/708, 439/786; 24/341, 339; 403/397, 398; 40/130

(56) References Cited

U.S. PATENT DOCUMENTS 3,447,253 * 6/1969 Coad ..... 40/130
4,666,109 * 5/1987 Fallon et al. ..... 248/50
4,688,961 * 8/1987 Shioda et al. ..... 403/389

* cited by examiner

*Primary Examiner*—Kenneth J. Ramsey

(57) ABSTRACT

A new art form of neon lights in forming functional shapes, letters and numbers of a single plane suitable to being mounted with the use of clips which also supply electricity to light the tubes of neon letters when the clips are secured to two metal rods inserted in vertical plastic hangers and hung, such as in a window and end pieces which have the electrical connections built in, are applied at both the rods at either end and a transformer lead is connected to provide its DC power.

23 Claims, 6 Drawing Sheets

CHANGEABLE NEON LETTERS

BACKGROUND OF THE INVENTION

#1 Field of the Invention

The present invention generally involves the field of technology pertaining to neon lighting, and more particularly to neon letters and numbers which, due to a new art in forming the letters as a method of bending each letter on a flat surface and bringing all tube ends within the dimensional confines of the letter itself, yet allowing sufficient access for exhausting tubes and electrical hookups. The letters have no bendbacks or exhaust tube bendouts to hamper the use they were made for, that is, to be attached to state-of-the-art clip which can hold the letter firmly in one clip while allowing a second clip to change its angle to accommodate the different angles found in handmade neon shapes, then to snap onto the rods which are part of the frame used to support the letters. This frame is made of two metal rods, one separated from the other by two mounting strips of plastic with three holes, two for the rods to go through providing the proper separation to secure the two rods as far apart as the letters require for support and secure mounting, then while snapping onto this frame. The clip also containing an electric contact, will connect one side of the DC current used to illuminate the letters using one each of two clips, one to each of the two rods and will supply DC to the letters from a 110 V transformer connected to an end piece which holds the rods and electrically connects the rods. The third hole in the plastic strip is used to hang or otherwise mount the sign, the same strip of plastic having three holes so placed that they can also be used to support a second, third or more equal length signs, one under the other. The holes have been placed just for this purpose. Each letter will support a small electrical converter which converts the very low voltage of the DC transformer to high enough voltage to light the neon. A clip is provided for the converter to be snapped onto each letter.

#2 Description of Prior Art

Nothing found of significance to our claims.

SUMMARY OF THE INVENTION

According to the present invention shapes, letters and numbers can be made from neon tubing in a new way which permits the forms to be totally flat and only as thick as the tube it is bent from, larger radiuses with fewer sharp bends in the glass thus making it easier to bend the forms of letters and other shapes, very important in the manufacturing of tubular glass parts and because of the planar construction of the neon lights, it is easier to securely mount the fragile glass flat on a simple frame with snap clips made of plastic that are part of this invention as the state of the art letter attachment clip makes an individual letter approach of neon signs possible and practical. The mounting device provides two clips opposing each other through a mechanical system which allows one clip to be aligned with the other clip designed for any two objects to be attached to each other, a neon letter handmade of non-precision and irregular glass tubes can be properly mounted and align with the parts used in supporting them, also the clip serves to provide power from the metal frame to the converter that produces the high voltage to light the tube by having a hole just below the arc that receives the frame rod, allowing a bare wire to be fed through and bent over the bottom of the arc, making a firm electrical contact to the frame rod when inserted. The electricity to power the neon sign is from a series of connections starting with a low voltage transformer plugged into a 110 V wall outlet, then its 12 V DC lead is plugged into a receptical at the end of the sign endpiece wherein wires are connected to spring clips which hold rods in position, current flows through the rods to the mounting clips, then to the converter which uses the 12 V DC delivered to it to boost the voltage to 1000 volts which is connected to the cathode leads of the letter it will light. Also the rod is easy to snap in and snap out due to the appendages mounted on each lip of the clip so when the fingers push down on these appendages, the clip is forced open by spreading the lips of the clip, the side pressure is removed from the rod. It will then easily move in or out of the clip.

Another feature of the invention is the do it yourself possibility as a simple no tools needed way to connect the wires, is shown.

It is the object of this invention to show that the design for the new letters is not obvious as there are many ways of mounting a standard neon letter, but the old design did not accommodate the use that the new letters can be put to. Thus the present need did not inspire changes in the letter design as the new forms of mounting were not available so I have invented a new kind of mounting clip which leads the line of thought to use these letters in many formerly unobvious ways. In fact, both the new mounting clip and the newly designed letters, each by themselves, would have been completely overlooked as needed items.

It is therefore the object of the present invention to provide devices to make a neon sign from which its letters can be removed, serviced, changed or replaced.

It is also the object of the present invention to show that by a new art a neon sign can be made fuctional by lower voltage and safer electrical components combined with a new form of neon letters which are more compact and of a single plane in construction thus easier to transport and making it much easier to mount and maintain, It is another object of the invention, to produce such a neon tube that is flat and can be used to make signs only as thick as the glass tubes used to make the letter itself.

It is another object of the invention, that approximately 100 seven inch letters can be safely packed with separate containers in a carton only 2×1×1 cu. feet.

It is yet another object of the invention, that the neon letters are formed to the confines of the dimensions of the letter with no extended exhaust tubes or electrical appendages extended.

It is yet another object of the invention, to make a neon letter that can be mounted individually upon a frame.

It is a further object of the invention, that a new, slim frame is used to mount a set of single letters and support the functional needs of the letters.

It is yet another object of the invention that the voltage needed to supply a single letter is low enough not to create a damaging electronic field, therefore no television or radio interference.

It is a further object of this invention to produce a new system of neon signs that allow complete changes of letters in minutes.

It is the object of this invention, to show that when a change is needed in a regular neon sign, it will have to be discarded and a new sign made. But with a sign made in this new form, you need only rearrange letters or perhaps add a few low cost additional letters to make the new sign fully usable at a fraction of the cost of making a new sign. Signs can be moved to new locations without the help of technicians, eadily disassembled, packed up and moved and are reusable in minutes at the new location.

Another unobvious feature is that neon can be used for many things it was never previously used for, such as the daily winning lottery numbers. Numbers can be changed in minutes, also daily specials, changing gasoline prices at the pump, flight information and movie marquees, etc.

DETAILED DESCRIPTION OF THE PREFERRED EMBODIMENT

A new sign that can give up its letters one at a time is the preferred embodiment of the invention which will now be described with specific reference to the several views of the drawings. It is to be understood that the letters are being shown with their support inventions for the full operation and function of a neon sign.

Letters of the alphabet or other forms that can be shaped from glass tubes and exhausted of oxygen with neon or any appropriate gas introduced so as to cause two electrodes, when high voltage is introduced from the ends of the tube to energize the gas to cause a fully lit tube. This is neon lighting.

Figure 2:
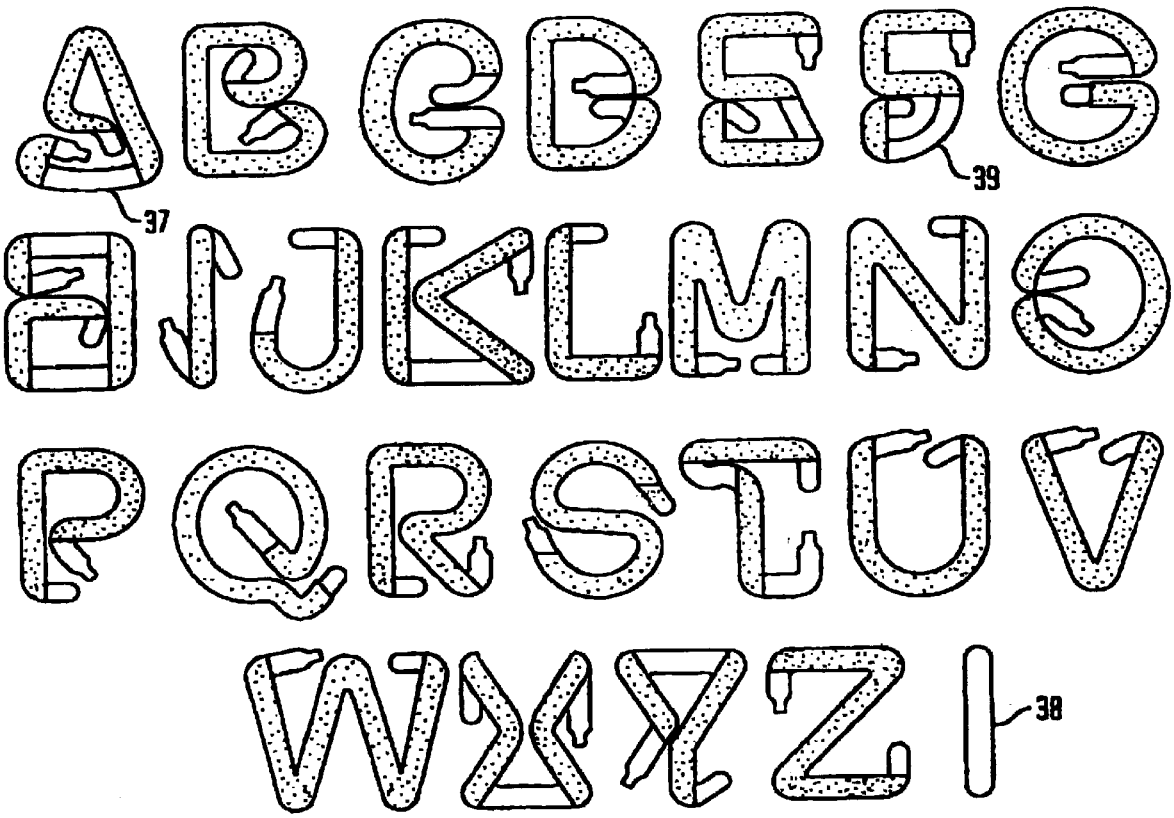
FIG. 2 shows the 26 neon letters of the alphabet in their new form.

The improvement of this art is the formation of the letters to form a letter of glass tubing on a flat plane only as thin as the glass tubing 38, see FIG. 2. Prior letters used doubling-back bending, meaning possible 3 or 4 times the tube thickness, to say nothing of the electrodes being bent from the main body of the tube and protruding away from the letter.

Figure 3:
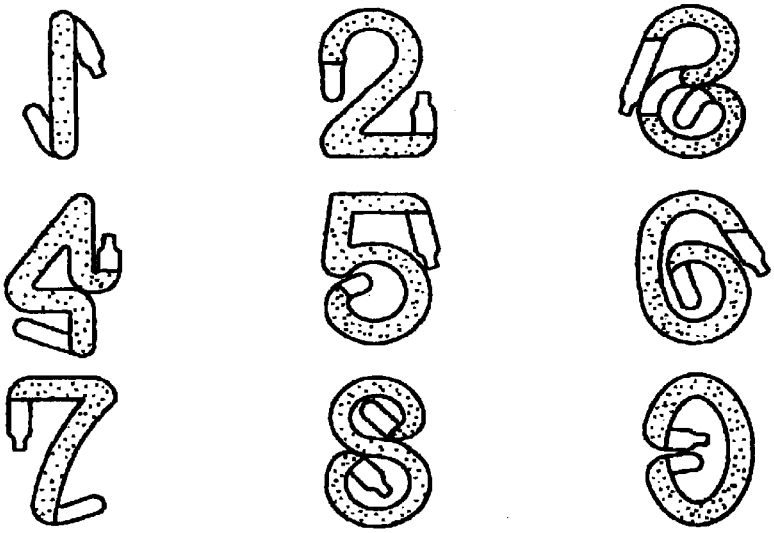
FIG. 3 shows the numbers 0 through 9 in their new form.

This is changed by creating a new method of forming letters, numbers and other shapes in glass. For instance, one embodiment could use a full alphabet and numbers 0 to 9 according to FIG. 2 and FIG. 3 with each letter and number bent within a plane. This means that signs can be made thinner. Signs can be made of individual letters, 16 (FIG. 7) each completely contained even as to their high voltage needs. That is, converters, 11, can be associated with each letter and each letter then only subject to two points of contact with a low voltage supply to operate. See FIGS. 6 and 7.

Figure 7:
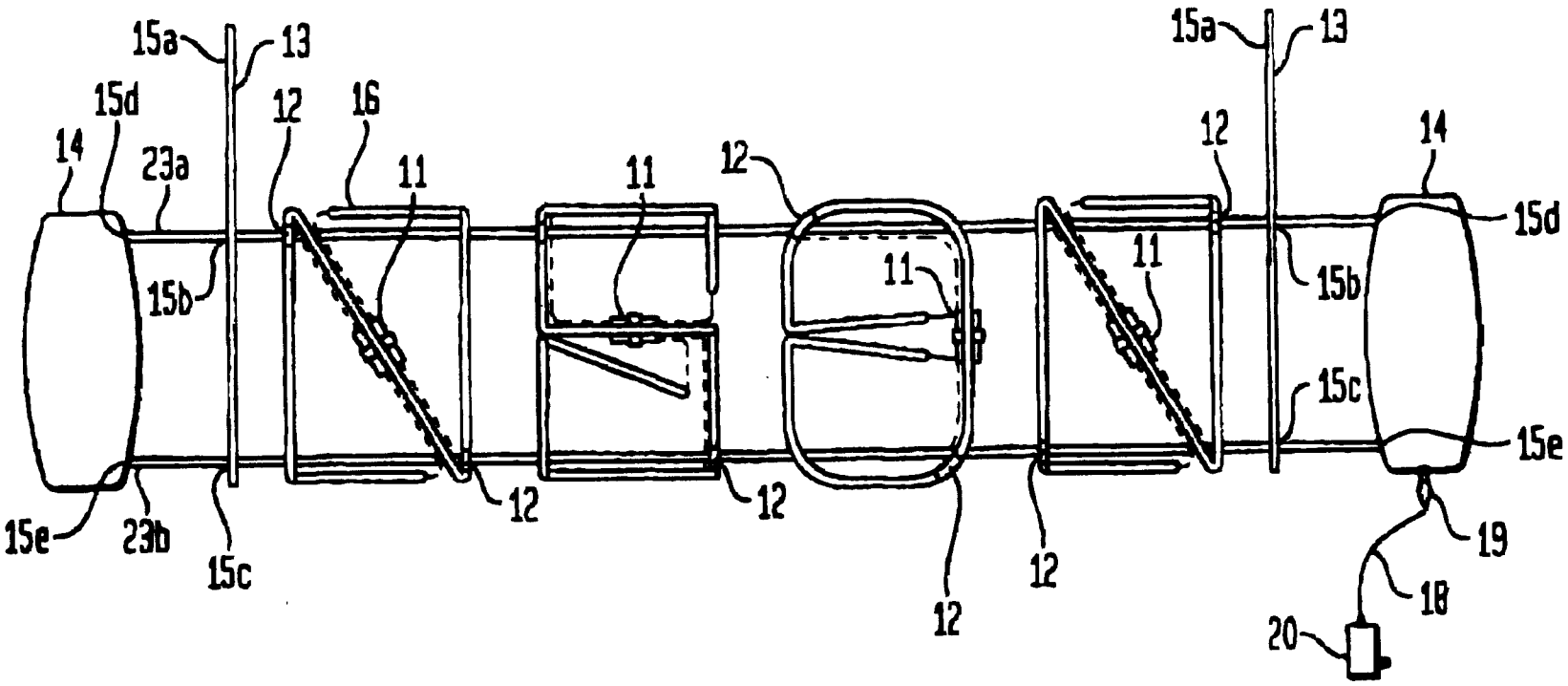
FIG. 7 shows the complete sign.
Figure 8A:
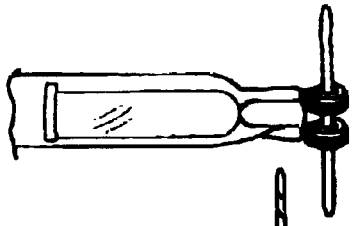
FIG. 8 shows the 6 steps to connect a wire to the neon tube.
Figure 8B:
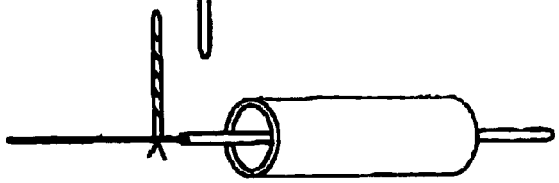
Figure 8C:
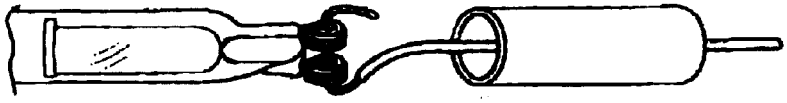
Figure 8D:
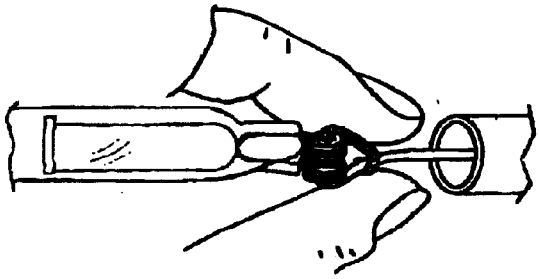
Figure 8E:
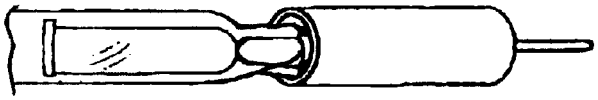
Figure 8F:
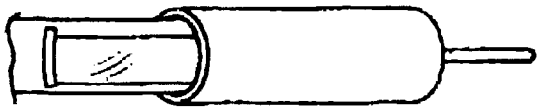

Letters so described can be individually placed on a support frame, as in FIG. 7 to be assembled into words and signs of any imaginable use, small or large, colors and endless designs.

I believe this to be a generic new entry to the neon field.

The present invention is made up of ideas creating a system including the shape of bent glass planar letters and forms of all descriptions (e.g. FIGS. 2 & 3) in a way that they would be strong, attractive, marketable and cost efficient. We have a needed, usable product made highly practicable with a unique two part attachment clip, FIG. 1, which holds the glass letters firmly to a frame, FIG. 7.

Figure 1A:
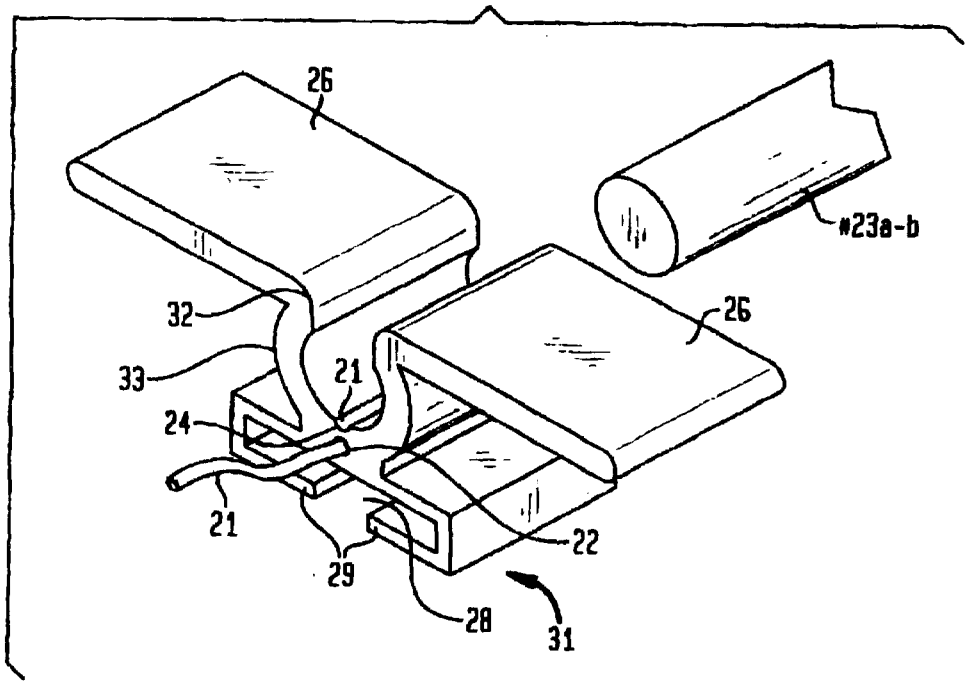
FIGS. 1A through 1C illustrate the two part mounting clip for attaching neon tube to the metal rods of the frame.
Figure 1B:
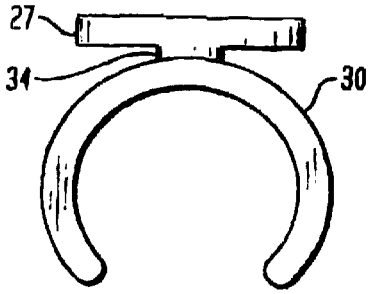
Figure 1C:
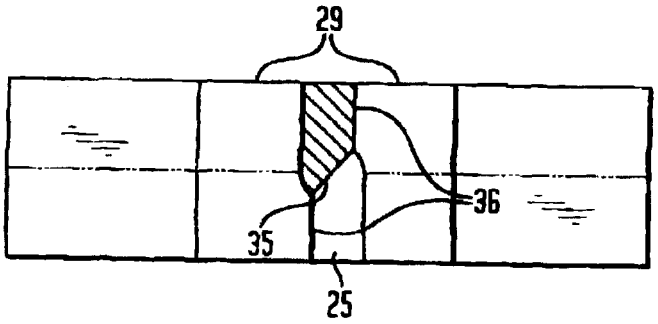

The mounting clip is comprised of two parts, "A" and "B". Part "A" contains most of the functional parts that make it unique. In FIG. 1 there is shown a channel, 33 cylindrical in shape with the opening at the top whereupon the topmost of the channel has sides, 32 tapered in such a way that if a rod, 23*a* or 23*b*, were to be snapped in, sides, 32, would force it down into the channel and secure it there. It is particularly important the beveled edges, 32, pushes the rod downward as a wire, 21, is fed through hole, 22, and bent back into a groove, 24, then compressed by rod 23, which is forced down past edge, 32, and held firmly. By such means a solid electrical contact is made, supplying power to the low voltage leads of converter, 11. On the top edge of the clip, two appendages, 26, are attached, so fingers can press downward and relieve the pressure of the clip upon the rod, 23, to make inserting and removing the rod easier. Located below the channel is a pivot box, 31, slotted at the bottom with edges, 29, facing each other. The size of the slot, 28, at the center of the pivot box, 31 is the same as the diameter of the shaft, 34, on part B because the raised areas alternately placed on the edges, 29, of the pivot box, 31, narrows the passages on either side of the center. When the shaft, 34, (FIG. 1B) of the rounded top is forced into the slot, 28, of part "A", its shaft must pass the narrow sections, 36, (FIG. 1C). When it comes to the center of the slot it will be locked in place. Part of the invention is the molding procedure used to place raised areas of plastic beyond the center of the parting line, of the mold. Ordinarily only possible with cams and pins in the procedure, a slanted parting line in the core allows control of the plastic flow above and below the parting line, 35. When part "A" and part "B" are mated by pressing the shaft, 34, on part 30 (FIG. 1B) with the disc, 27, into slot 28, the clamp is fully assembled, the rotation of each part of the clamp is possible, so that the angle to each other can be changed to meet the need. Whereupon a neon letter can be mounted into the clamp of part "B" and the rod, 23, snapped into part "A" of the mounting clip and then rotated for alignment to mount on a frame. While the rod, 23*a* , is held securely, the wire, 21, is also made functional.

The frame of the sign is characterized by its end pieces, 14, one of which contains an electrical receptical, 19, (FIG. 5) and internal metal spring clips, 43*a* and 43*b* which supply current to two separated parallel rods 23*a* and 23*b*, and also help to hold the rods in place. The rods run the full length of the sign, thus supplying a mounting platform on which the letters can be placed by the use of the clips, 12, (FIG. 1) attached to the neon tubing, 16, and to the metal rods, 23*a* & 23*b*.

Clips, 12, are attached to rods 23*a* & 23*b*, low current leads. 17*a*, 17*b* of the converters, 11, (which are mounted upon the neon tubing) are pressed in contact with respective rods 23*a* and 23*b*. The converter high voltage leads, 17*c* and 17*d*, are then connected to the cathode lead of the letters which completes the circuit and lights the neon tubes.

Figure 4A:
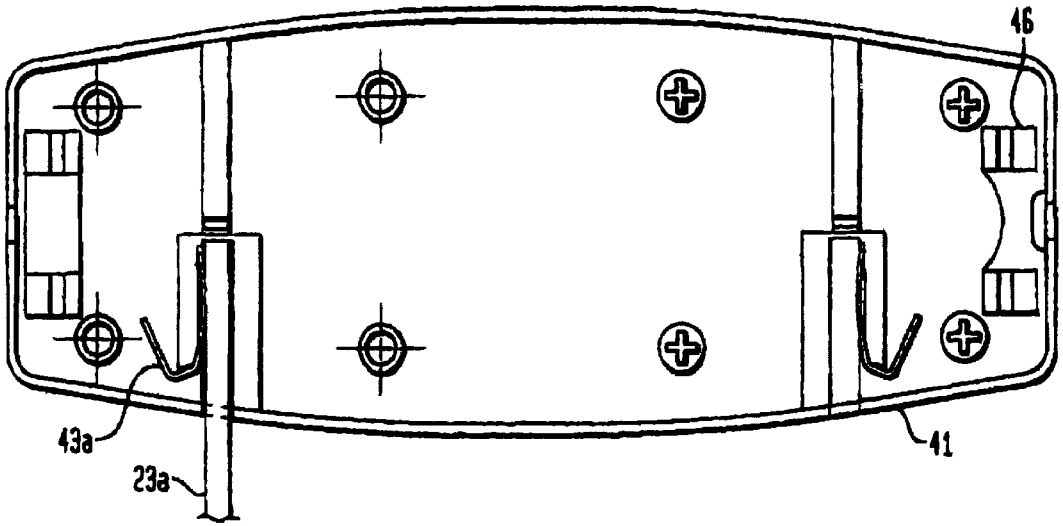
FIGS. 4A and 4B show the end pieces to which the two horizontal rods of the frame are attached.
Figure 6:
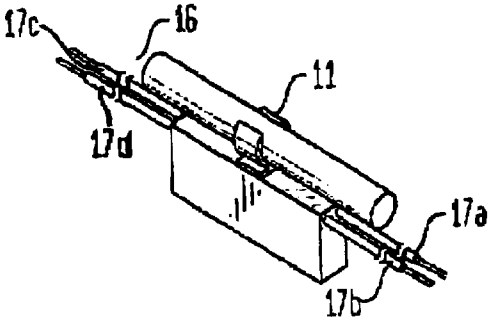
FIG. 6 shows the mounting of a power converter to the neon tube.

A frame for the new art of neon also includes two vertical plastic mounting straps, 13, which hold two horizontal metal rods, 23*a* and 23*b*, which are then held in place while the straps, 13, are separated enough to permit balancing of the sign when the hanging points, e.g. holes, 15*a*, are attached to a secure object high enough to show the sign at its desired height, and two end pieces, 14, of the frame help to stabilize the rods 23*a* and 23*b* which are inserted into holes 15*d* and 15*e* of the end pieces and act as conductors for the electric power to light the sign from a 110 V DC transformer. The lower voltage of 12 V DC, FIG. 7 #18, is delivered to a socket, 40, mounted at hole 15 H of FIG. 4A at the base of the end piece. The socket, 40, is wired with wires to two clips, 43*a* and 43*b* which receive rods 23*a* and 23*b* whereupon the power is then picked up by the wires 17*a* and 17*b* of the converter, 21 (FIGS. 6 & 7). Wires 17*a* and 17*b* are held in contact with rods, 23, by clips, 12 (FIG. 1) and the high voltage wires, 17*c* and 17*d* of the converters, 11, are connected to the cathodes of the neon tubing. The converter, 11, may be snapped onto the neon tubing. Clips 12 (FIG. 1) are snapped onto rods 23*a* or 23*b* of the frame, FIG. 7.

The method of hanging the sign also allows one to substantially expand it by using two added straps, 13, FIG. 7, with holes 15*a* slipped onto lower rod, 23*b* , with another two rods installed by slipping them into holes, 15*b* and 15*c* of the added straps on which to attach the second single line of letters below, thence still larger signs, simply by repeating the expansion method using the hanging straps with a dual purpose.

Neon letters, even in the fabrication process, can be brittle and unstable with weak areas caused by 180° bends of 150° as in bending the tube outside or the stretched side will cause the thin glass sections that will break easily, also a sharply bent tube will tend to flatten one side while widening the tube, a very undesirable effect, while with the new method of making letters, it is unnecessary to have a bend of more than 140° for most ot the bends. More particularly, the 26 letter font shown in FIG. 2 #39 has characteristics of having all ends containing the electrodes and fill tubes contained within the confines of the letters' physical dimensions and all on one plane so the letters are single plane as shown by 38 of FIG. 2. The letter "A" in FIG. 2, portion 37 shows how instead of folding or bending back the crossover in the letter and doubling back to the angular leg, then bending to continue to the bottom of the leg, the new letter as shown does not bend back but smoothly bends across the bottom between the two legs and curves upward bending to engage the upper part of the leg, then to bend inward to conceal the cathode. The letter and none of the bend exceeds 140° . Ordinarily the bendback of the cross piece would need a 180° bend, very hard and often not completely successful as thin areas occur that cause collapsing during fabrication and leave thin walls in the glass which break easily.

Figure 4B:
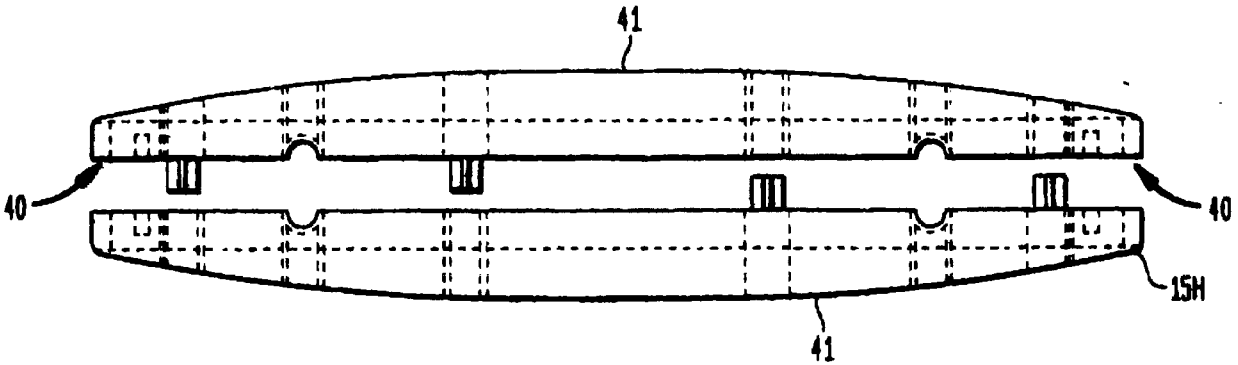
Figure 5:
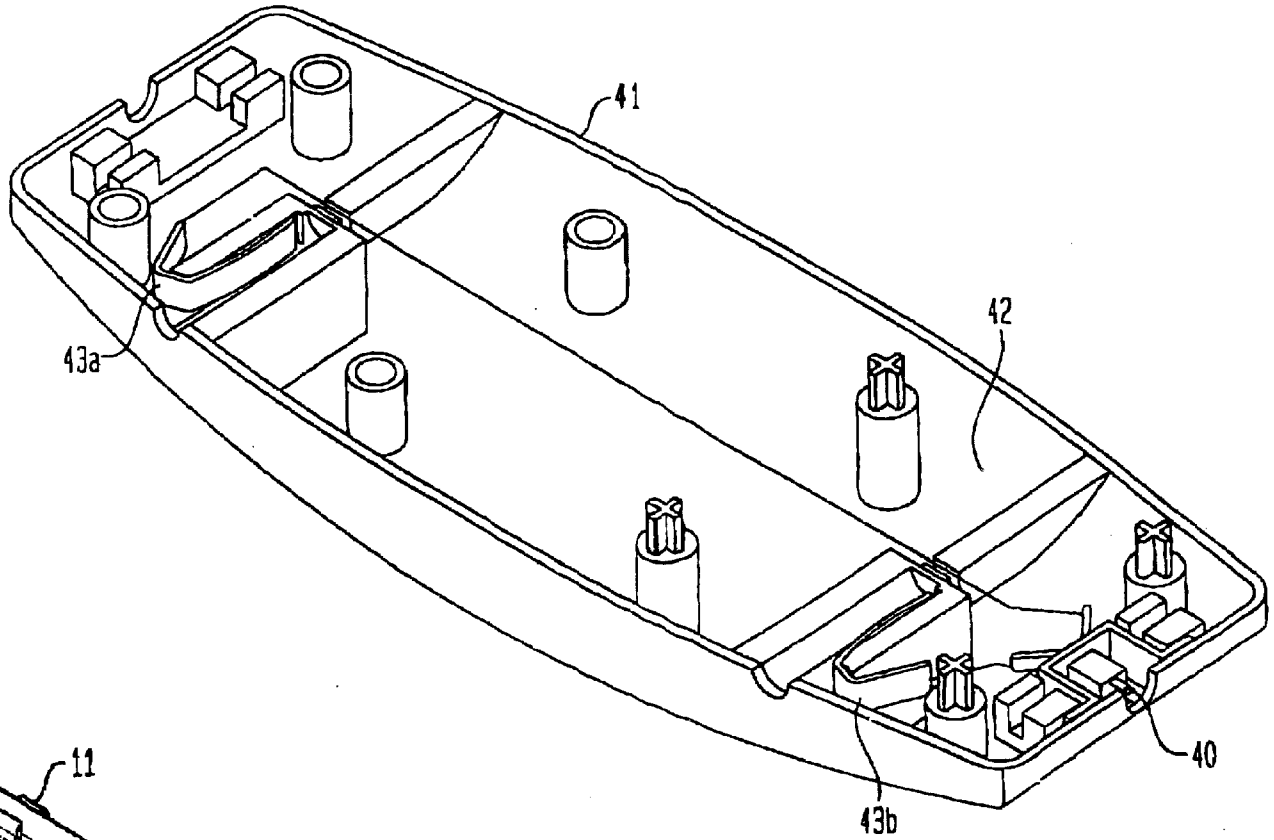
FIG. 5 illustrates how the electric power is connected to the horizontal rods of the frame.

End piece for the sign is shown in FIGS. 4, 5 & 6. FIG. 4, side view of the end piece shows how the molded parts are symetrical and only one mold is used to mold 4 halves of which any two will fit together to make one end piece. It is shown that plugs and holes molded in the plastic, interlock, thereby securing the two halves together, forming a single end piece. The bottom view, FIG. 4 whows the position and relationship each plug and hole has to each other, further shown in FIG. 5. Hole 44 and plug 45 are made to press together with 45 having a cross shape that when entering hole 44 will expand its outer wall causing a friction fit that will not pull apart easily. Also shown is the socket for the transformer plug, 40, 12 V DC supply mounted in a plastic nest, one half remains exposed to be nested in the other half to be turned 180° and pressed on. The contact springs 43*a* and 43*b* also are nested equally in each half. FIG. 4B shows a rod, 23*a* inserted into the socket with a compressed holding spring, 43*a*, in place. The wires connecting the 12 V DC plug, 40 to both clips 43*a* and 43*b*. Neon tube cathode wires shown, FIG. 2 #50 is the object of this section of the invention of a way to connect the high voltage wires to the neon tube without using tools or additional clips and connectors as the cathodes are joined to the letters when being made and have two one-inch wires protruding from the ends as these wires are rolled up, FIG. 8, to form a circle of wire not unlike a coil spring, a wire stripped of some of its insulation baring some of its wire at the end. Toothpick is used to clear holes in the two wire coils at the ends of each letter, when clear, remove toothpick. Push wire through hols in the end of the boot and bend wire up, attention being paid to space from insulation to bend. Insert wire into coiled wire eyelets and bend end over. Squeeze wire with fingers until touching each other and maintaining a light spring tension. Push boot to enlarged section of glass while holding wire in rear. Hold glass about 1 inch from end and push boot on until about ⅛" over the larger diameter glass tube. The DC connection from the 12 V transformer is made by stripping each of the two converter 12 V input wires 17*a* and 17*b* about one and one-quarter inches from the end and pushing the bare wire into a hole provided in each of the mounting clips, FIG. 1, then bending the wire back over the bottom, 21, of the rod-encompassing clip so that when the clips are attached to the rods, 23*a* and 23*b*, the rods will snug tight against the wires, 17*a* and 17*b* for tight electrical connection.

To make signs of glass, one can contemplate much breakage of tubes after manufacturing in the shipping process to the distributor, the dealer and then the customer. Only with a styrofoam box designed to pack each tube separately, can you still pack over 100 tubes in a carton 24"×12"×12" and therefore lower shipping cost and have less damage to the product. This is possible because the tube can be packed in a container cavity limited in size only by the thickness of the glass tube and the length and width of the letter or shape being packed. Corners are placed on the underside of the box. When the boxes are stacked, the corners insert into the box below and secure the position of the box. The bottom of each box also serves as a lid for any lower box.

What is claimed is:

1. A method of making a neon sign of interchangeable, substantially planar letters, numbers or shapes of glass tubing using a kit of independent single tube gas-filled letters, numbers or shapes of two dimensional form substantially only as thick as the tube of which said letters, numbers or shapes are formed, including at least one letter A or letter E or numeral 8 of said two dimensional form without any doubling or crossover, comprising providing a frame and mounting selected letters, numbers or shapes from said kit onto said frame.

2. A method of making a neon sign of interchangeable planar letters, numbers or shapes of glass tubing as set forth in claim 1, said interchangeable planar letters, numbers or shapes consisting of letters shaped substantially as the corresponding letters shown in FIG. 2 of the drawings.

3. A method of making a neon sign of interchangeable planar letters, numbers or shapes of glass tubing as set forth in claim 1, wherein said letters, numbers or shapes are snapped onto said frame.

4. A method of making a neon sign of interchangeable planar letters, numbers or shapes of glass tubing as set forth in claim 1, wherein said sign operates on a low voltage power supply.

5. A method of making a neon sign of interchangeable planar letters, numbers or shapes of glass tubing as set forth in claim 1, wherein said sign operates on a 12 volt DC power supply.

6. A method of making a neon sign of interchangeable planar letters, numbers or shapes of glass tubing as set forth in claim 1, wherein each letter, number or shape is powered by its own converter.

7. A method of making a neon sign of interchangeable planar letters, numbers or shapes of glass tubing as set forth in claim 6 wherein each converter can be physically supported by the corresponding letter, number or shape of said sign.

8. A method of making a neon sign of interchangeable planar letters, numbers or shapes of glass tubing as set forth in claim 6 wherein electrical connections between the planer letters, numbers or shapes and the corresponding converter are made without any permanent connection, wire nuts, connecting clips or plugs attached to the ends of the wires.

9. A method of making a neon sign of interchangeable planar letters, numbers or shapes of glass tubing as set forth in claim 1, wherein said letters, numbers or shapes are powered in parallel whereby if one letter, number of shape goes out, the others will remain lighted.

10. A method of making a neon sign of interchangeable planar letters, numbers or shapes of glass tubing as set forth in claim 1, wherein said frame comprises two rod shaped members onto which said letters, numbers or shapes are snapped mounted, said rod shape members providing power to said sign.

11. A two part clip for joining two rod shaped members side by side at various angles to each other, comprising a first part for snap attachment to a first member and a second part for snap attachment to the second member, said parts being joined together by a channel shaped pivot box on a first part and a interfitting rounded top on the second part, said pivot box providing recess means for locking said rounded top in place within said pivot box.

12. A two part clip as in claim 11 wherein said pivot box has two lateral flanges which cooperate to provide said locking means.

13. A two part clip as in claim 11 wherein one of said rod shaped members comprises a portion of a neon light bulb and the other rod shaped member comprises a bulb support means.

14. A two part clip as in claim 11 wherein the two lateral flanges are shaped so that the first part can be molded with a core forming the flanges adapted to be parted along a slanted parting line without the use of cams or pins.

15. A two part clip as in claim 11 wherein at least one part has an hole for receiving an electric wire in electrical connection with the corresponding rod like member.

16. A frame for a neon sign, the frame comprising two metal rods for securing a first row of neon letters, numbers or shapes, two mounting strips and two end pieces, each mounting strip having three holes including two holes holding the two metal rods in parallel one above the other and an upper hole for suspending the frame, said upper holes being of a diameter such that a like frame can be suspended from the lower metal rod of the first thus providing a support for mounting a second row of letters, numbers or shapes below the firs trow, the two end pieces each having two holes each secured to one end of the two metal rods.

17. A frame for a neon sign as in claim 16, wherein each end piece is made of two plastic parts press fitted together.

18. A frame for a neon sign as in claim 17, wherein the two plastic parts of each end piece are identical one to the other.

19. A frame for a neon sign as in claim 17, wherein all four plastic parts of the two end pieces are identical.

20. A frame for a neon sign as in claim 16, wherein the plastic parts, the two mounting strips and the two metal rods are adapted to be secured together without any tools.

21. A frame for a neon sign as in claim 16 wherein one of the end pieces contains electrical connections for supplying current to the neon sign.

22. A frame as in claim 21 wherein the electrical connections electrically connect a power supply to the two metal rods.

23. A neon sign, said sign being made by the process of claim 1.

* * * * *